United States Patent [19]

Cardinal

[11] Patent Number: 5,013,875

[45] Date of Patent: May 7, 1991

[54] CONTACT CONFIGURATION WITH AN ARCING HORN AND AN ARC CONDUCTING PIECE

[75] Inventor: Andreas Cardinal, Berlin, Fed. Rep. of Germany

[73] Assignee: Siemens Aktiengesellschaft, Munich and Berlin, Fed. Rep. of Germany

[21] Appl. No.: 477,959

[22] PCT Filed: Nov. 4, 1988

[86] PCT No.: PCT/DE88/00693

§ 371 Date: May 24, 1990

§ 102(e) Date: May 24, 1990

[87] PCT Pub. No.: WO89/05036

PCT Pub. Date: Jun. 1, 1989

[30] Foreign Application Priority Data

Nov. 25, 1988 [DE] Fed. Rep. of Germany ... 8715757[U]

[51] Int. Cl.[5] ..... H01H 33/12

[52] U.S. Cl. ..... 200/146 R

[58] Field of Search ..... 200/146 R

[56] References Cited

U.S. PATENT DOCUMENTS

| | | | |
|---|---|---|---|
| 2,372,045 | 3/1945 | Armstrong | 200/147 R |
| 3,784,775 | 1/1974 | Gryctko | 200/146 R |

FOREIGN PATENT DOCUMENTS

| | | |
|---|---|---|
| 0222684 | 5/1987 | European Pat. Off. . |
| 1000486 | 1/1957 | Fed. Rep. of Germany . |
| 3539673 | 5/1987 | Fed. Rep. of Germany . |
| 2613125 | 9/1988 | France . |

*Primary Examiner*—Robert S. Macon

*Attorney, Agent, or Firm*—Kenyon & Kenyon

[57] ABSTRACT

A contact configuration (1) for low-voltage circuit-breakers has main and arcing contacts (6, 17; 10; 21) as well as arcing horns (22, 23) for transferring an arc into an arc quench chamber. Additional arc conducting pieces (30; 40) take over partial arcs that can occur on the main contacts (6; 17) when the contact configuration (1) is highly stressed, and carry them over to the corresponding arcing horn (22). The arc conducting pieces (30; 40) are designed more or less as angular, one-piece, stamped, flexural parts, whereby an arc conducting shank (36), which originates at a base shank (31) used for mounting is linked up at a sharp angle to the arcing horn (22).

3 Claims, 1 Drawing Sheet

CONTACT CONFIGURATION WITH AN ARCING HORN AND AN ARC CONDUCTING PIECE

The invention relates to a contact configuration for a low-voltage circuit-breaker having main contacts for conducting a continuous current and arcing contacts for igniting an arc in the entrance region of an arc quench chamber, and also having an arc conducting piece manufactured as a one-piece stamped, flexural part made of ferromagnetic material for transferring an arc occurring on the main contacts over to the arcing horn.

A contact configuration of this type has become known as a result of the DE-A-35 39 673. It provides for manufacturing the arc conducting pieces as cast parts or as stamped, flexural parts, whereby a massive, that is a solid design is considered advantageous. It has also been proven that arc conducting pieces designed as cast parts ensure the mode of operation that is aspired to.

To simplify the manufacturing process and to reduce production expenditure, however, it would be desirable to make use of the possibility that is likewise indicated, of designing the arc conducting pieces as stamped, flexural parts. However, it turns out that one only attains the mode of operation with a lesser degree of perfection.

Starting from here, the invention is directed toward the task of creating an arc conducting piece that can be manufactured as a stamped, flexural part, which even with a simple design fulfills the task of carrying arcs that develop on the main contacts quickly and reliably to the arcing horn.

This is achieved according to the invention in that the arc conducting piece designed as a one-piece, stamped, flexural part has a base shank extending more or less parallel to the row of main contacts and used for mounting on the support of the main contacts, and an arc conducting shank, which originates at the end of the base shank that is distant from the arcing horn, and is linked up at an angle to this end, whereby the base shank has two separated base shanks which are separated by an incision and which have a mutual displacement corresponding to a gradation of the mounting surface of the arc conducting piece. In contrast to the known arc conducting piece mentioned the new arc conducting piece thus does not have a closed, triangular form. Nevertheless, it was determined that one attains the same success [with the new arc conducting piece] as one does with the triangular and massive arc conducting piece.

To achieve a good transition of the arcs to the arcing horn, it is recommended to provide the outer end part of the arc conducting shank with a bent design that is more or less parallel to the arcing horn.

The mounting surface for the arc conducting pieces that is provided on the support of the main contact can possibly have a graduated design. To produce a reliable mounting for the arc conducting pieces, it is therefore beneficial to provide the side of the arc conducting piece used for mounting with a corresponding, graduated shape as well. The arc conducting piece provided according to the invention and designed as a stamped, flexural part can likewise be given this graduated shape, by forming partial base shanks that are separated by a slit and are offset from one another.

The invention is explained more closely in the following based on the exemplified embodiment depicted in the Figures.

Figure 3:
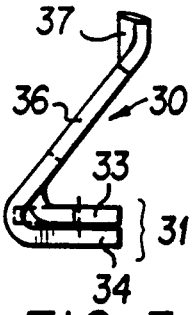
Figure 4:
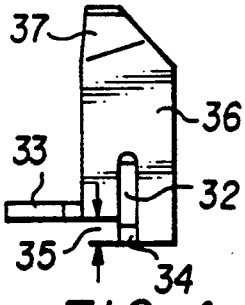
Figure 5:
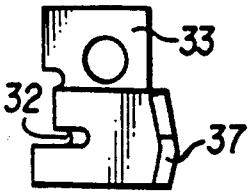

Details of the arc conducting piece are depicted in FIGS. 3, 4 and 5, each showing views at right angles to one other.

Figure 1:
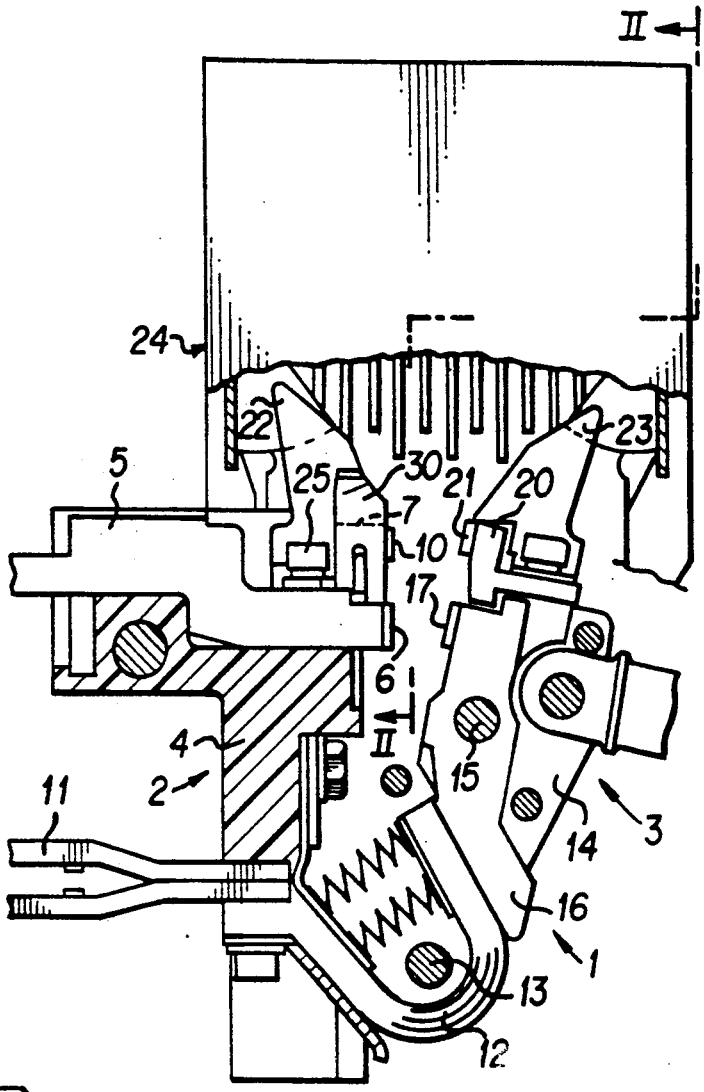
FIG. 1 shows in a section a pole of a low-voltage circuit-breaker with an arc conducting piece.

The contact configuration according to FIG. 1 comprises in a well-known way a stationary part 2 and a movable part 3. An insulating block 4 is used as a support for the stationary part 2 of the contact configuration 1. An upper connecting bar 5, which is used at the same time as a support " for a stationary main contact and for this purpose is provided with a contact facing 6 or a larger number of such contact facings, is mounted on this insulating block 4. A stationary arcing contact 7, that is likewise provided with a contact facing 10, is attached to the connecting bar 5 near the contact facing 6. Attached to the bottom side of the insulating block 4 showing an angular profile is a further, bifurcated connecting bar 11, which has a flexible connector 12 connected to it by a screw. The flexible connector 12 produces the electrically conductive connection to the movable part 3 of the contact configuration 1, which [part 3] swivels around a joint bolt 13 disposed between the shanks of the flexible connector 12 that is bent in a U-shape. The movable part 3 comprises a support 14, on which main contact levers 16 that are connected to the flexible connector 12 swivel around a joint bolt 15. These main contact levers 16 are provided on their upper end with contact facings 17 that interact with the stationary contact facings 6. In addition, the support 14 has an arcing contact 20, which possesses a contact facing 21 that interacts with the stationary contact facing 10. Both the stationary part 2 as well as the movable part 3 of the contact configuration possess an arcing horn 22 or 23 for carrying arcs over into an arc quench chamber 24.

Figure 2:
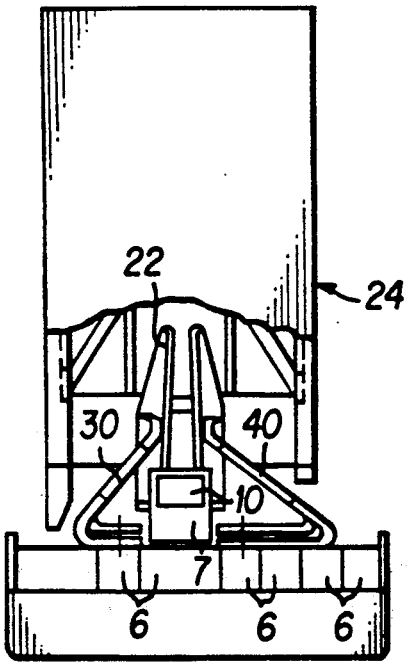
FIG. 2 shows the intersection II—II of FIG. 1, whereby the left and right sections of FIG. 2 illustrate different specific embodiments.

As illustrated in FIG. 2, two stationary contact facings 6 are provided as main contacts. Accordingly, the movable contact 3 of the contact configuration 1 features two side-by-side contact levers with contact facings 17. As a function of the current, that the circuit-breaker is supposed to control with respect to a permissible heating [level], a larger number of main contacts can be provided. To illustrate this, two contact facings 6 are shown in the right part of FIG. 2, so that in this design the contact configuration has altogether four main contacts.

If the parts move at [the time of] the breaking operation in a way as known, such that first the main contacts, and shortly after the arcing contacts, are separated from each other, then an arc is formed only at the arcing contacts, provided that the total current flowing through the contact configuration does not exceed a certain level. The arc is then taken over by the arcing horns 22 and 23 and carried over into the arc quench chamber 24. However, if the current exceeds a certain magnitude, then the current is not completely commutated on the arcing contacts, with the result that partial arcs also appear on the main contacts, that is between the contact facings 6 and 17. These partial arcs are taken over by arc conducting pieces 30 or 40, that are shown in FIG. 3 in a form to be adapted to the respective design of the contact configuration. As one can see, these arc conducting pieces form conducting edges to take over the partial arcs appearing on the main contacts and to carry them over to the arcing horn 22.

The arc conducting piece 30 according to FIGS. 3, 4 and 5 is a stamped, flexural part made of sheet metal, and it has a base shank 31, that has two partial base shanks 33 and 34 separated by a slit 32. This provides not only for an adaptation to the graduated shape of the connecting bar 5 in the region of the contact facing 6, but at the same time provides a locked seating for the attachment using only one screw 25 (FIG. 1). The partial base shanks 33 and 34 are mutually offset to an extent that is denoted with 35.

Starting from the external end, relative to the axis of symmetry of the contact configuration, the arc conducting piece 30 has an arc conducting shank 36, which is situated at a sharp angle to the base shank 31 and is linked up by way of its upper, bent end part 37 to the arcing horn 22.

As one can see by examining the left and right side of the contact configuration shown in FIG. 2, the shape of the arc conducting pieces as explained above can be easily adapted to contact configurations of varying widths, that is to contact configurations with a varying number of main contacts, in that the base shank is provided with an appropriate length and, in the same way, the length and angle position of the arc conducting shank is selected accordingly [to match]. In this manner, one obtains the arc conducting piece 40.

With the help of the new arc conducting pieces as described, it is possible to considerably increase the performance of contact configurations by using a simple and inexpensive accessory part.

I claim:

1. A contact configuration for low-voltage circuit-breakers having main contacts for conducting a continuous current and arcing contacts for igniting an arc in the entrance region of an arc quench chamber, and also having at least one arcing horn for carrying over the arc into the arc quench chamber, and having an arc conducting piece made of ferromagnetic material for carrying an arc occurring on the main contacts over to the arcing horn, characterized in that the arc conducting piece (30) designed as a one-piece, stamped, flexural part has a base shank (31) extending more or less parallel to the row of main contacts (6), and an arc conducting shank (36), which originates at the end of the base shank (31) that is distant from the arcing horn (22), and is linked up at an angle to this end.

2. The contact configuration according to claim 1, characterized in that the outer end part (37) of the arc conducting shank (36) has a bent design that is more or less parallel to the arcing horn (22).

3. The contact configuration according to claim 1, characterized in that the base shank (31) has two partial base shanks (33, 34) that are separated by a slit (32) and that these partial base shanks (33, 34) exhibit a mutual offset (35).

* * * * *